United States Patent [19]

Knopfel et al.

[11] 4,019,829

[45] Apr. 26, 1977

[54] CENTRIFUGAL PUMP WITH INDUCER

[75] Inventors: Hans-Dieter Knopfel; Heinz-Bernd Matthias, both of Frankenthal, Germany

[73] Assignee: Klein, Schanzlin & Becker Aktiengesellschaft, Frankenthal, Germany

[22] Filed: Aug. 8, 1975

[21] Appl. No.: 603,087

[30] Foreign Application Priority Data

Aug. 22, 1974 Germany ..... 2440230

[52] U.S. Cl. ..... 415/143; 415/DIG. 1

[51] Int. Cl.[2] ..... F04D 1/00

[58] Field of Search ..... 415/74, 73, 143, DIG. 1; 259/96

[56] References Cited

UNITED STATES PATENTS

| | | | |
|---|---|---|---|
| 1,125,118 | 1/1915 | Kerr | 415/143 |
| 1,851,513 | 3/1932 | Holmstrum | 415/DIG. 1 |
| 2,013,079 | 9/1935 | Slocum | 415/143 |
| 2,737,897 | 3/1956 | Dewees | 415/143 |
| 2,807,932 | 10/1957 | Bodine, Jr. | 415/119 |
| 2,973,716 | 3/1961 | Thomas | 415/119 |
| 3,384,022 | 5/1968 | Oshima | 415/DIG. 1 |
| 3,494,291 | 2/1970 | Carter, Jr. | 415/143 |
| 3,508,842 | 4/1970 | Lievens | 415/DIG. 1 |

FOREIGN PATENTS OR APPLICATIONS

| | | | |
|---|---|---|---|
| 883,358 | 3/1943 | France | 415/143 |
| 1,264,360 | 3/1968 | Germany | 415/DIG. 1 |
| 494,608 | 9/1951 | Italy | 415/143 |

*Primary Examiner*—Henry F. Raduazo
*Attorney, Agent, or Firm*—Michael J. Striker

[57] ABSTRACT

A centrifugal pump wherein the inducer in front of the impeller is a propeller and has a hub whose rear end face, which is immediately adjacent to the front end portion of the impeller, has a circumferential groove. When the pump is in operation, especially in the partial load range, the customary turbulence develops in the groove so that it does not interfere with the flow of fluid from the intake into the impeller. This reduces the tendency of fluid to pulsate with attendant reduction of noise.

8 Claims, 1 Drawing Figures

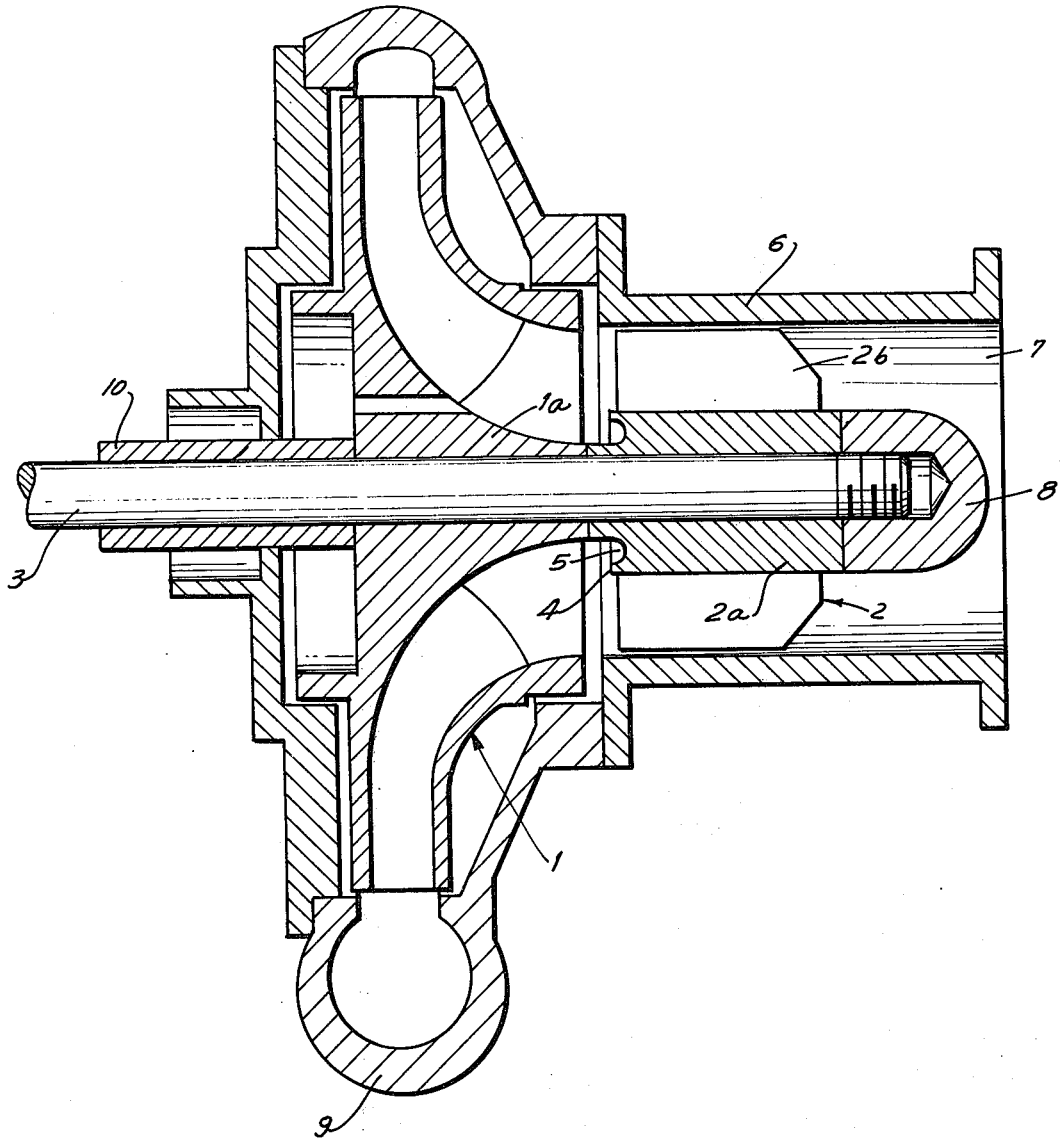
6
7
2b
10
1a
8
3
5
4
2a
2
1
9

CENTRIFUGAL PUMP WITH INDUCER

BACKGROUND OF THE INVENTION

The present invention relates to centrifugal pumps in general, especially to multi-stage volute type centrifugal pumps, and more particularly to improvements in inducers for use in centrifugal pumps. Still more particularly, the invention relates to improvements in propeller type inducers for use in centrifugal pumps.

The inducer of a centrifugal pump serves as a means for feeding fluid (e.g., water or another liquid) to the adjacent impeller. The output of such inducers is normally selected in such a way that they can achieve the net positive suction head of the associated impeller at a predetermined operating point. In accordance with the criteria on which the operation of a centrifugal pump with an inducer is based, the inducer should operate in the partial load range (i.e., at less than full capacity) at any operating point of the pump. As a rule, the inducer is a propeller (i.e., it induces axial flow of fluid). A drawback of conventional inducers is that, when they are operated in the partial load range, they invariably generate turbulence (flow coming out of the impeller toward the inducer) which results in noise, pulsating fluid flow and unstable operation of the pump.

Attempts to overcome the drawbacks of conventional porpeller-type inducers include the placing of an apertured disk in front of the inducer. The disk is intended to reduce pulsations of the fluid stream and to reduce the space which is available for development of back-flow turbulence. It has been found that the disk is incapable of appreciably reducing the noise because noise develops as a result of turbulence and the apertured disk merely reduces or confines but cannot eliminate turbulence.

German offenlagungsschrift Pat. No. 1,528,836 discloses an inducer with a hub whose diameter increases in the direction of fluid flow. The hub carries a circumferentially extending blade. The purpose of the specially designed hub is to fill the region in which the reflux or back-flow turbulence develops. Such types of inducers reduce turbulence at the rated point of the pump; however, they are much less effective in the partial load range.

SUMMARY OF THE INVENTION

An object of the invention is to provide a centrifugal pump which generates less noise than conventional centrifugal pumps.

Another object of the invention is to provide a novel and improved inducer for use in centrifugal pumps.

A further object of the invention is to provide an inducer which insures pulsation-free and practically noiseless operation of the pump at and beyond the duty point.

An additional object of the invention is to provide an impeller which can confine eventual turbulence in an area where the turbulence cannot interfere with satisfactory flow of fluid from the intake into the impeller.

Still another object of the invention is to provide an impeller which insures satisfactory operation of the pump at and beyond the rated capacity.

An ancillary object of the invention is to provide an improved propeller-type or axial-flow inducer for use in single-stage or multi-stage centrifugal pumps.

The invention is embodied in a centrifugal pump which comprises a casing or housing having an intake, an impeller which is rotatably mounted in the casing, and a rotary inducer which is coaxial with the impeller and is disposed between the impeller and the intake. In accordance with a feature of the invention, the preferably cylindrical hub of the inducer has an end face which is adjacent to the rear end portion of the impeller and has an annular recess or groove. The end face of the hub preferably extends radially beyond the rear end portion of the impeller and the recess also extends, at least in part, radially beyond the rear end portion of the impeller. The inducer is preferably a propeller.

The novel features which are considered as characteristic of the invention are set forth in particular in the appended claims. The improved inducer itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE is a fragmentary axial sectional view of a volute type centrifugal pump which embodies the improved inducer.

DESCRIPTION OF THE PREFERRED EMBODIMENTS

The drawing shows a single-stage or multi-stage volute type centrifugal pump having a casing or housing 6 with an intake 7 and a volute 9. The means for driving the impeller 1 comprises a shaft 3 which is mounted in bearings 10 and is driven by a suitable prime mover, not shown. The impeller 1 discharges fluid into the volute 9 and receives fluid from an inducer 2 which is a propeller having a hollow cylindrical hub **2*a* secured to the shaft 3 in front of the impeller 1 and several blades 2*b*. The inducer 2 is surrounded by a cylindrical portion of the casing 6 and is held against axial movement by a cap 8 which is threadedly connected with the right-hand end portion of the shaft 3. The rear end face 4 of the hub 2*a* is adjacent to the impeller 1 and has a circumferentially complete annular groove or recess 5 which is bounded by a concave surface. The inner diameter of the groove 5 equals or approximates the outer diameter of the adjacent front end portion 1*a* of the impeller 1.**

When the pump is in operation, the impeller 1 draws fluid through the intake 7 and forces pressurized fluid to flow into the volute 9 which can deliver fluid directly to the outlet (not shown) or into the next stage of the centrifugal pump. Turbulence, if any, develops in the groove 5 so that the area surrounding the hub **2*a* allows for practically unimpeded axial flow of fluid into the impeller 1.** The illustrated impeller is of the medium-pressure type.

It has been found that the simple and inexpensive expedient of forming the rear end face of the inducer hub **2*a* with a groove or recess insures highly satisfactory operation of the centrifugal pump at or in excess of rated capacity, i.e., beyond the so-called duty point. The end face 4 of the hub 2*a* is preferably stepped, i.e., it includes an inner annular portion which abuts against the rear end portion 1*a* of the impeller 1 and an outer annular portion which surrounds the groove 5 and is nearer to the intake 7 than the inner annular portion. Such design of the end face 4 insures that the turbulence which is especially likely to develop in the partial load range takes place in the groove 5 while the periphery of the hub 2***a* is free of turbulence so that the fluid can flow into the impeller 1 without any pulsations, generation of noise and like undesirable phenomena. The beneficial effect of the groove 5 can be readily observed with a stroboscope, and it can also be determined by comparative tests, i.e., by monitoring the output of a pump having a customary propeller-type inducer and the output of the illustrated pump. As stated above, the improved inducer insures a more uniform flow of fluid, also in the partial load range, and the tendency of fluid to pulsate is greatly reduced or eliminated. This, in turn, results in very pronounced reduction of noise. The cost of machining the groove 5 into the front end face of the inducer is negligible.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. In a centrifugal pump, a combination comprising a casing having an intake; a centrifugal impeller rotatably mounted in said casing and having a first hub provided with an upstream end face; and a rotary inducer coaxial with said impeller and disposed in said casing intermediate said intake and said impeller, said inducer including a second hub having a downstream end face abutting said upstream end face of said first hub and having a diameter larger than said upstream end face of said first hub, said second hub further having an annular fluid recess provided in said downstream end face in the outer portion of said downstream end face, and said recess having an inner diameter which is at least equal to the outer diameter of said upstream end face of said first hub, said annular fluid recess facing towards said first hub, whereby turbulence tending to form at the downstream end of said inducer in the fluid flowing through said casing is alleviated.

2. A combination as defined in claim 1, wherein downstream end face having an inner annular portion immediately adjacent to said upstream end face of said impeller and a second annular portion spacedly surrounding said first annular portion, said recess being disposed between said annular portions.

3. A combination as defined in claim 2, wherein said second annular portion is nearer to said intake than said first annular portion.

4. A combination as defined in claim 1, wherein said casing has a volute surrounding said impeller.

5. A combination as defined in claim 1, wherein said second hub is a hollow cylinder.

6. A combination as defined in claim 1, further comprising a common drive shaft for said hubs.

7. A combination as defined in claim 6, further comprising means for holding said inducer against axial movement relative to said impeller.

8. In a centrifugal pump as defined in claim 1, said first hub having an outer circumferential surface, said annular fluid recess being inwardly bounded by a surface forming a continuous surface with said outer circumferential surface of said first hub.

* * * * *